US008724835B2

(12) United States Patent
Kerselaers et al.

(10) Patent No.: US 8,724,835 B2
(45) Date of Patent: May 13, 2014

(54) RADIO RECEIVER, RADIO TRANSMITTER, AND HEARING AID

(75) Inventors: Anthony Kerselaers, Herstelt (BE); Felix Elsen, Pellenberg (BE)

(73) Assignee: NXP B.V., Eindhoven (NL)

( * ) Notice: Subject to any disclaimer, the term of this patent is extended or adjusted under 35 U.S.C. 154(b) by 864 days.

(21) Appl. No.: 12/158,314

(22) PCT Filed: Dec. 15, 2006

(86) PCT No.: PCT/IB2006/054892

§ 371 (c)(1),
(2), (4) Date: Jun. 19, 2008

(87) PCT Pub. No.: WO2007/072381

PCT Pub. Date: Jun. 28, 2007

(65) Prior Publication Data

US 2008/0267436 A1 Oct. 30, 2008

(30) Foreign Application Priority Data

Dec. 19, 2005 (EP) ..... 05112372

(51) Int. Cl.
*H04R 25/00* (2006.01)

(52) U.S. Cl.
USPC ..... 381/315; 381/68

(58) Field of Classification Search
USPC ..... 381/68, 315
See application file for complete search history.

(56) References Cited

U.S. PATENT DOCUMENTS

| | | | | |
|---|---|---|---|---|
| 2,953,782 | A | 9/1960 | Byatt | |
| 4,298,793 | A | 11/1981 | Melis et al. | |
| 4,303,910 | A * | 12/1981 | McCann | 340/572.2 |
| 5,721,783 | A * | 2/1998 | Anderson | 381/328 |
| 5,854,970 | A | 12/1998 | Kivela | |
| 6,127,979 | A | 10/2000 | Zhou et al. | |
| 6,437,750 | B1 * | 8/2002 | Grimes et al. | 343/726 |
| 6,606,069 | B2 | 8/2003 | Kitamura et al. | |
| 2003/0132893 | A1 * | 7/2003 | Forster et al. | 343/895 |
| 2005/0052287 | A1 | 3/2005 | Whitesmith et al. | |
| 2006/0017623 | A1 * | 1/2006 | Luch | 343/700 MS |

FOREIGN PATENT DOCUMENTS

| | | | |
|---|---|---|---|
| EP | 1026779 | A2 | 8/2000 |
| EP | 1555715 | A1 | 7/2005 |
| EP | 1316240 | B | 11/2005 |

(Continued)

OTHER PUBLICATIONS

Kurz, Gunter: Oszillatoren, Informationselektronik, Verlag Technick 1988, p. 107.

*Primary Examiner* — Dale E Page

(57) ABSTRACT

A receiver (30) with an antenna circuit is disclosed, which antenna circuit comprises a coil (31) and either a monopole (35) or a dipole connected to the coil (31). The antenna circuit captures a signal with a wavelength transmitted by a transmitter (1). The coil (31) captures the signal and generates therefrom a current having a frequency corresponding to the wavelength. The coil (31) is dimensioned such that the current is distributed uniformly within the coil (31) at each point in time. Preferably, the monopole (35) or a leg of the dipole has a length corresponding to less than 5% of the wavelength. The invention further relates to a radio transmitter of the same kind. Finally, the invention relates to an RFID tag, a smart card, a mobile device, and a hearing aid, each comprising an inventive receiver (30) and/or an inventive transmitter.

11 Claims, 3 Drawing Sheets

(56) References Cited

FOREIGN PATENT DOCUMENTS

| | | | |
|---|---|---|---|
| JP | 56002707 | A | 1/1981 |
| JP | 2001007619 | A | 1/2001 |
| JP | 2003274489 | A | 9/2003 |
| JP | 2005303963 | A | 10/2005 |
| WO | 02095870 | A1 | 11/2002 |
| WO | 2005081583 | A | 9/2005 |

* cited by examiner

RADIO RECEIVER, RADIO TRANSMITTER, AND HEARING AID

FIELD OF THE INVENTION

The invention relates to a radio receiver with an antenna circuit which captures a signal with a wavelength transmitted by a transmitter; said antenna circuit comprising a coil generating, by capturing said signal, a current having a frequency corresponding to said wavelength. The invention furthermore relates to a radio transmitter of the same kind. Finally, the invention relates to an RFID tag, a smart card, a mobile device, and a hearing aid, each comprising an inventive receiver and/or an inventive transmitter.

BACKGROUND OF THE INVENTION

A variety of radio systems are available nowadays for transmitting signals wirelessly over a very short distance of less than approximately 1.5 m. Examples of such systems are Bluetooth, NFC (Near Field Communication) and WLAN (Wireless Local Area Network), etc. In general, all radio systems suffer from one common problem, namely how to obtain as wide as possible a radio range at the lowest possible power consumption. If the distance between sender and receiver is too great or if the radio power is too low, errors in the data transmission may occur, possibly even resulting in a complete breakdown of a radio link.

Various methods have been devised to increase the radio range of a transmitter/receiver system. One is published in EP 1 026 779 A2, which discloses a dipole antenna with a loop as a first pole and an appendage with a strip terminating in a pad as a second pole. The circumference of the loop is of the order of one half-wavelength of an operation frequency and an effective length of the appendage is at least 0.15 times the wavelength. Since the loop of the antenna is of the order of one half-wavelength of an operation frequency, it generates an electromagnetic wave and the electric charge is not uniformly distributed over the loop. However, the use of such an antenna furthermore results in correspondingly bulky devices, in particular if the chosen frequency for the radio transmission is relatively low, since the antenna is then relatively large. The ever decreasing size of present-day devices, necessitates the choice of a relatively high frequency for the radio link, which obviously is a limitation in designing such a device, in particular because fewer free frequencies are available for radio links than was the case in earlier times.

OBJECT AND SUMMARY OF THE INVENTION

It is an object of the present invention to provide a receiver which provides a better reception of an incoming signal transmitted from a sender over a relatively short distance.

It is also an object of the present invention to provide a transmitter which provides a better transmission of a signal over a relatively short distance.

The object of the invention is achieved by means of a receiver with an antenna circuit which captures a signal with a wavelength transmitted by a transmitter; the antenna circuit comprising: a coil that captures the signal and generates therefrom a current having a frequency corresponding to said wavelength; the coil being dimensioned such that the current is distributed uniformly within the coil at each point in time; and either a monopole or a dipole connected to the coil. The inventive receiver is particularly designed to receive the signal from a transmitter which is located at a relatively short distance to the receiver, preferably less than 1.5 m, and even more preferably within a range of a few centimeters up to about 50 cm. The inventive receiver is thus especially designed to operate within the near field of the transmitter. The antenna of the inventive receiver comprises the coil and the dipole or monopole. The coil is small enough for the current induced by the received signal to be uniformly distributed within the coil at each point in time. To this end, the coil is designed to be coupled magnetically to the transmitter. This is in contrast to a looped antenna, whose length is in the range of the wavelength or of the order of one half-wavelength of the received signal. These antennas are designed to capture an electromagnetic wave. The antenna circuit of the inventive receiver comprises, in addition to the coil, the dipole or monopole. The dipole or monopole is used to capture an electric field of the received signal. As a result, the receiver has an improved performance compared with a receiver whose antenna circuit is only comprised of a coil when used in the near field of the transmitter. The dipole or monopole may have any suitable shape, such as a straight line or a meandering line. The dipole or monopole may also be a short wire connected to the antenna circuit.

The additional monopole or dipole renders it possible to utilize a relatively small coil for the antenna circuit. It is therefore possible to utilize a coil whose size (i.e. the diameter of the coil or the largest extension transverse to the axis for non-circular coils) amounts to less than 5% of the wavelength. Smaller coils are also feasible, such as a coil whose dimension is less than 1.5%, less than 1%, or even less than 0.5% of the wavelength of the received signal. This renders it possible to manufacture relatively small receivers which can be used in a wide range of products.

According to a restricted version of the inventive method, the monopole has a length corresponding to less than 5% or even less than 1% of the wavelength of the received signal. According to a further restricted version of the inventive method, the dipole has a total length corresponding to less than 10% or even less than 2% of the wavelength of the received signal. In this manner the dipole or monopole does not significantly contribute to the size of the receiver.

In order to tune the inventive receiver to the frequency of the received signal, the inventive receiver may comprise at least one capacitor which together with the coil may constitute an LC-tuned circuit. This enhances the performance of the inventive receiver.

The object of the invention is also achieved by means of a transmitter with an antenna circuit which transmits a signal with a wavelength; the antenna circuit comprising: a coil dimensioned such that a current flowing through the coil and related to the transmitted signal is distributed uniformly within the coil at each point in time; and either a monopole or a dipole connected to the coil. Like the inventive receiver, the inventive transmitter is designed to operate in the near field, i.e. the inventive transmitter is designed to emit signals to a receiver placed preferably within less than 1.5 m, more preferably within a distance of the order of a few centimeters up to about 50 cm. The antenna of the inventive transmitter comprises the coil and the dipole or monopole. The coil is small enough for the current flowing through the coil to be uniformly distributed within the coil at each point in time. Therefore, the coil is designed to be coupled magnetically to the receiver. This is in contrast to a looped antenna, whose length is in the range of the wavelength or of the order of one half-wavelength of the emitted signal. These antennas are designed to emit an electromagnetic wave. The antenna circuit of the inventive receiver comprises, in addition to the coil, the dipole or monopole. The length of the monopole does not exceed a length corresponding to 5% of the wavelength of the transmitted radio signal (the total length of the dipole <10%). The dipole or monopole is used to emit an electric field. As a result, the inventive transmitter has an improved performance compared with a transmitter whose antenna circuit is only comprised of a coil when used in the near field. The dipole or monopole may have any suitable shape, such as a straight line or a meandering line. The dipole or monopole may also be a short wire connected to the antenna circuit.

The additional monopole or dipole renders it possible to utilize a relatively small coil for the antenna circuit. It is therefore possible to utilize a coil whose size amounts to less than 5% of the wavelength. Smaller coils are also feasible, such as a coil whose dimension is less than 1.5%, less than 1%, or even less than 0.5% of the wavelength of the emitted signal. This renders it possible to manufacture relatively small transmitters which can be used in a wide range of products.

According to a restricted version of the inventive method, the monopole has a length corresponding to less than 5% or even less than 1% of the wavelength of the received signal. According to a further restricted version of the inventive method, the dipole has a total length corresponding to less than 10% or even less than 2% of the wavelength of the received signal. In this manner the dipole or monopole does not significantly contribute to the size of the receiver.

In order to tune the inventive transmitter to a special frequency, the inventive transmitter may comprise at least one capacitor which together with the coil constitutes an LC-tuned circuit. This enhances the performance of the inventive transmitter.

The inventive transmitter or the inventive receiver may be used in a wide range of products. They may be used separately or combined in one product. As a combination, the inventive receiver and the inventive transmitter may be part of an RFID tag, a smart card, or other mobile devices, in particular mobile devices having a so-called NFC (Near Field Communication) interface.

The inventive receiver and the inventive transmitter may particularly form part of a hearing aid system, alone or in combination. Such a hearing aid system may particularly comprise a first module with a sender to send signals with a wavelength, and a second module with a loudspeaker, a receiver in the form of the inventive receiver, and a signal-processing device for processing the received signals and for controlling the loudspeaker. The loudspeaker may particularly be an in-ear loudspeaker. The first module of the inventive hearing aid comprises the sender and possibly further components, such as a microphone and an amplifier for receiving and amplifying speech or music. The sender sends signals corresponding to the music or speech to the second module. The inventive receiver renders it possible to design the second module so as to be relatively small, especially not larger than currently available in-ear hearing aids. Furthermore, the second module can be designed as a passive device, i.e. it does not comprise an active energy storage medium such as a battery. The second module may preferably comprise a passive energy storage element, such as a capacitor, which will be charged by the received signals. This makes it possible to reduce the size of the second module and to use bigger and longer-lasting batteries for the inventive hearing aid, since the battery need be used for the first module only, whose size is not as critical as the size of the second module. The first module, however, may alternatively or additionally comprise a music storage medium, such as an MP3-player.

These and other aspects of the invention are apparent from and will be elucidated with reference to the embodiments described hereinafter.

BRIEF DESCRIPTION OF THE DRAWINGS

The invention will be described in greater detail hereinafter, by way of non-limiting examples, with reference to the embodiments shown in the drawings.

DESCRIPTION OF EMBODIMENTS

Figure 1:
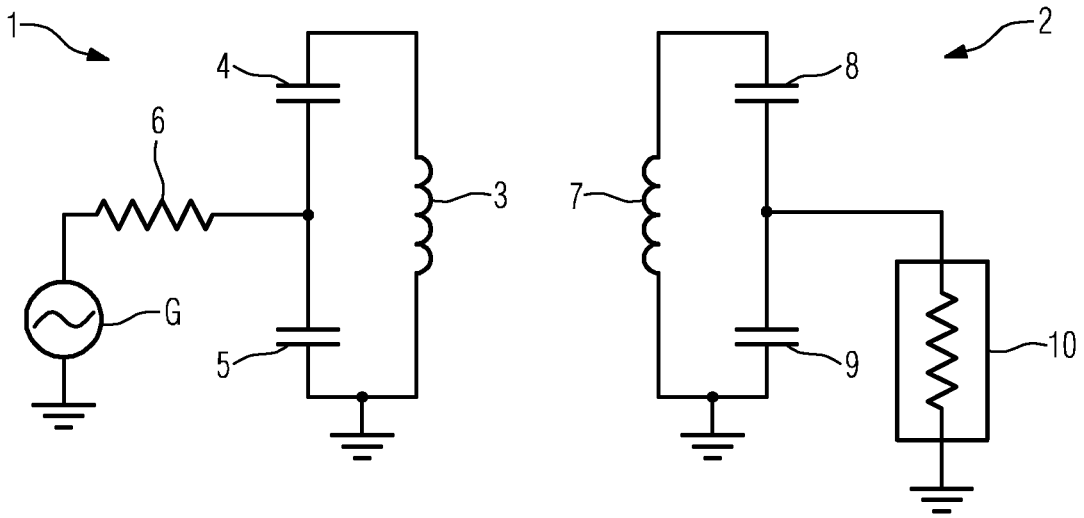
FIG. 1 is a prior art transmitter-receiver combination illustrating the general field of the invention.

FIG. 1 shows the circuit diagram of a transmitter 1, which transmits a signal to a receiver 2. The transmitter 1 and the receiver 2 are set up to be magnetically coupled, i.e. the receiver 2 and the transmitter 1 are spaced apart within a relatively short distance.

The transmitter 1 comprises a signal generator G that generates a signal. This signal is applied to a tuned LC circuit consisting of a coil 3 and two capacitors 4, 5. The coil 3 serves as an antenna of the transmitter 1. The transmitter 1 further comprises an output resistor 6.

The signal generated by the generator G causes a current with a given frequency to flow through the coil 3. Accordingly, the current through the coil 3 generates a magnetic field of a certain wavelength corresponding to the frequency of the current flowing through the coil 3.

The receiver 2 comprises a coil 7 and two capacitors 8, 9. The coil 7 of the receiver 2 operates as an antenna of the receiver 2. The coil 7 may be an air coil or a coil with a ferrite core. The coil 7 in combination with the two capacitors 8, 9 constitutes a tuned LC-circuit which is configured to supply a low-impedance load 10, for example 50Ω. The coil 7 of the receiver 2 captures the magnetic field generated by the coil 3 of the transmitter 1. This induces a current in the coil 7 of the receiver 2.

For the exemplary embodiment, the parameters of the tuned LC-circuit of the receiver 2 and the transmitter 1 are the same. The coils 3, 7 are each cylindrically wound on a ferrite core and each have a dimension of 1.5 mm diameter and 3 mm length. These dimensions are typical of, for example, hearing aid products.

Figure 2:
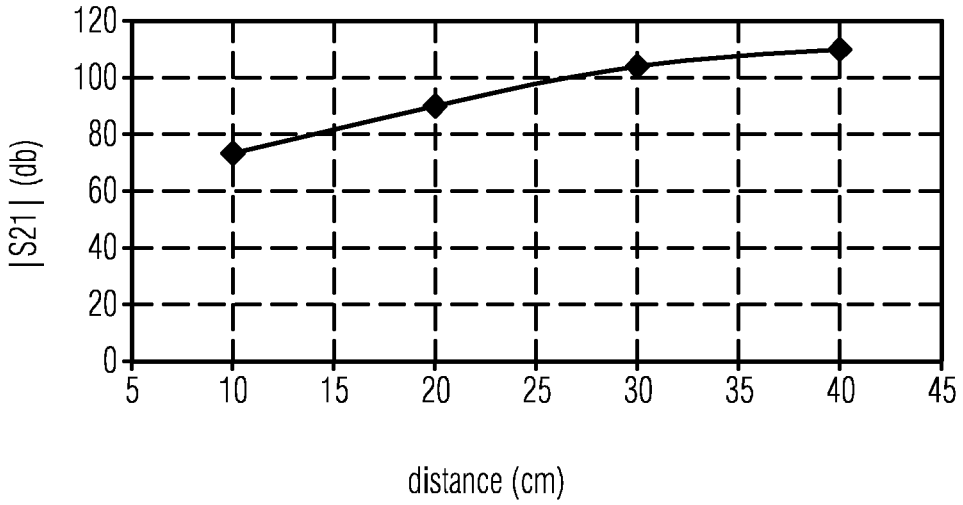
FIG. 2 illustrates the insertion loss magnetic coupling of the combination of FIG. 1.

FIG. 2. illustrates the insertion loss magnetic coupling of the combination of transmitter 1 and receiver 2 of FIG. 1. In telecommunication, the term insertion loss is defined as the loss resulting from the insertion of a device in a transmission line, expressed as the reciprocal of the ratio of the signal power delivered to that part of the line that follows the device to the signal power delivered to that same part before insertion. If the power emitted by the transmitter 1 is 0 dbm and if it is required that the signal detected by the receiver 2 is −90 dbm, then the combination of transmitter 1 and receiver 2 of FIG. 1 can be used within a distance of 20 cm. It can also be calculated for the set-up shown in FIG. 1 that the nearby magnetic field strength at, for example, 40 cm distance is 6 μA/m.

Even though the set-up of FIG. 1 is intended for magnetic coupling of the two coils 3 and 7 and even though the coil 3 of the transmitter 1 is relatively small, the coil 3 emits not just a magnetic field, but also a notable nearby electric field. The nearby electrical field originates from the circuit ground plane, the voltage across the terminals of the coil 3, and the dimensions of the coil 3, although the coil 3 is physically relatively small and is intended to generate a magnetic field only.

Figure 3:
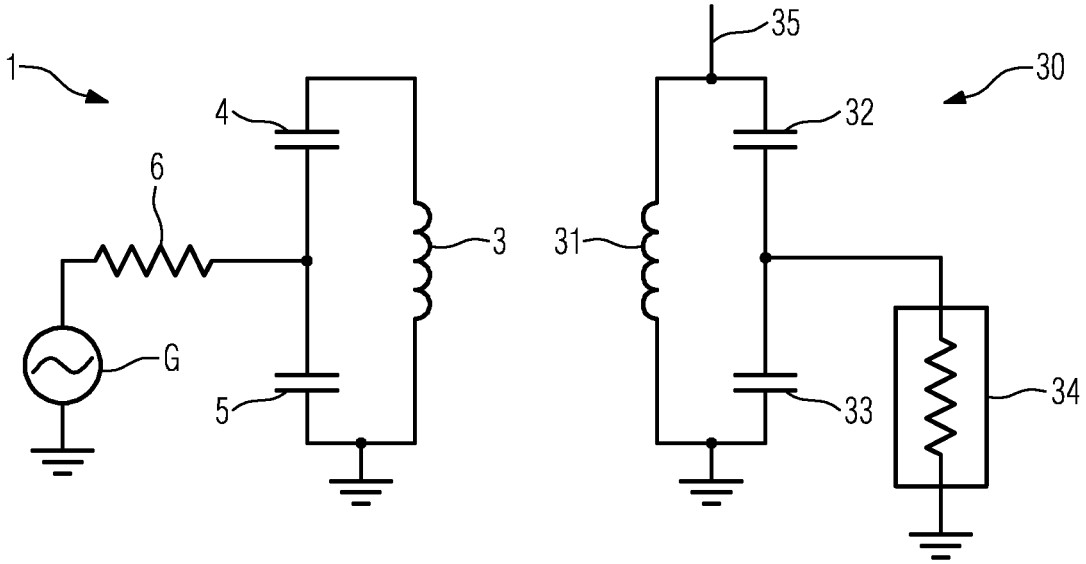
FIG. 3 is a transmitter-receiver combination whose receiver is an inventive receiver.

In order to exploit the electric field emitted by the transmitter 1 and thus enhance the performance of the set-up of FIG. 1, the receiver 2 is replaced by an inventive receiver 30 depicted in FIG. 3. The receiver 30 communicates with the transmitter 1 of FIG. 1.

The receiver 30 of FIG. 3 comprises a coil 31 and two capacitors 32, 33, constituting an LC-circuit which is configured to supply a low-impedance load 34 of 50Ω in the exemplary embodiment. The coil 31 is cylindrical, has a diameter of 1.5 mm and a length of 3 mm, and is wound on a ferrite core in the exemplary embodiment. If the received signal has a frequency of up to 30 MHz, then the diameter of a turn of the coil 31 is even less than 0.005 times the wavelength of the received signal. However, the coil 30 with a ferrite core may alternatively be replaced by an air coil. Again, the coil 3 of the transmitter 1 emits a field generated by the tuned circuit that is formed by the capacitors 4, 5 and the coil 7. The transmitted field comprises a magnetic field component and an electric field component. The magnetic field component is captured by the receiver's 30 coil 31, inducing a current with a frequency which corresponds to the wavelength of the received signal.

Additionally, the receiver 30 comprises a monopole antenna 35 connected to the coil 31. In this exemplary embodiment, the monopole antenna 35 is 3 cm long, corresponding to a length of less than 1% of the wavelength of the received signal. The monopole antenna 35 is sensitive to the electric field component of the received signal, thus increasing the sensitivity to received signals in the near field of the receiver 30 of FIG. 3 compared with the receiver 2 of FIG. 1.

Figure 4:
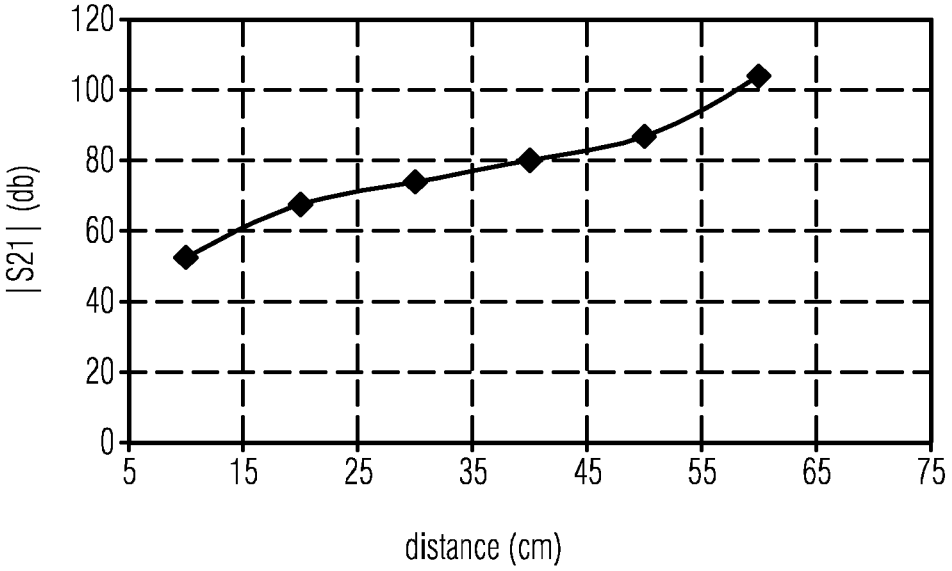
FIG. 4 illustrates the insertion loss electric and magnetic coupling of the combination of FIG. 3.

FIG. 4 shows measuring results of the insertion loss as a function of the distance between the transmitter 1 and the receiver 30. Obviously, the receiver 30 of FIG. 3 is more sensitive than the receiver 2 of FIG. 1. For example, the receiver 30 of FIG. 3 has an insertion loss of −90 dbm at 47 cm. If it is required that the insertion loss of a receiver shall be better than −90 dbm, then the receiver 2 of FIG. 1 can only be used up to a distance of 20 cm, whereas the receiver 30 of FIG. 3 can be used up to a distance of 47 cm owing to the addition of the monopole antenna 35.

The receiver 30 may be used in a wide range of products, such as an RFID tag, a smart card, a mobile device, or a hearing aid. The combination of antenna coil 31 and monopole antenna 35 of the receiver 30 can be used not only to receive a signal having a magnetic and an electric field, but also as a transmitting antenna circuit. Moreover, the monopole antenna 35 can be replaced by a dipole antenna having a total length corresponding to less than 10% of the wavelength of the received signal (accordingly, the legs of the dipole are each smaller than 5%).

Figure 5:
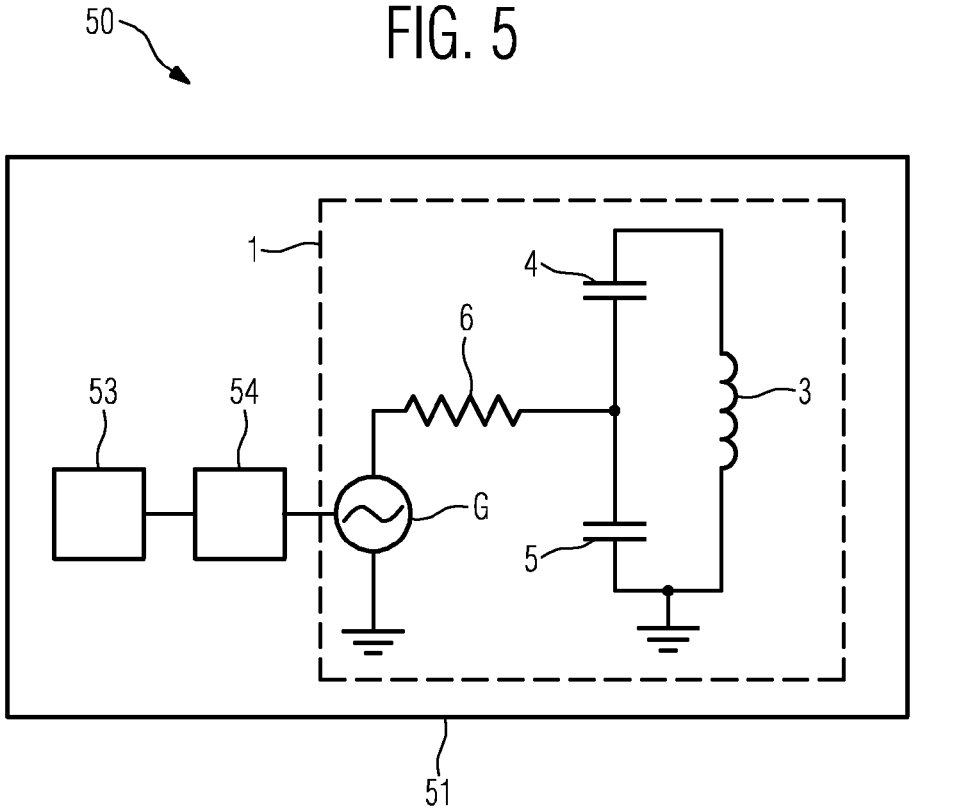
FIG. 5 shows a hearing aid system.
Figure 5:
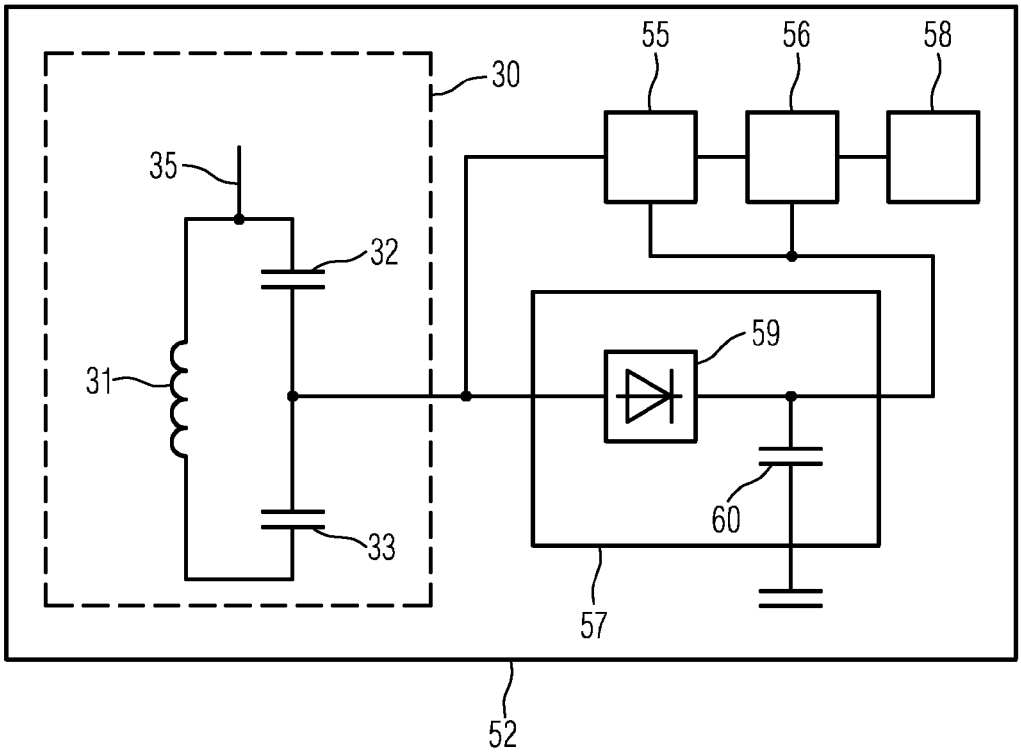

FIG. 5 shows an exemplary embodiment of a hearing aid 50 comprising a first module 51 and a second module 52 which communicates wirelessly with the first module.

In the exemplary embodiment, the first module 51 comprises the transmitter 1, a music or speech storage medium in the form of an MP3 player module 53, and a microcontroller 54 connected downstream of the MP3 player module. The microcontroller 54 modulates the music or speech signals stored and reproduced by the MP3 player 53 in a well known order so that the modulated signals can be transmitted by the transmitter 1 with a carrier frequency of about 30 MHz in this embodiment. An energy source in the form of a battery supplying the MP3 module 53, the microcontroller 54, and the generator G is not shown for the sake of clarity.

The second module 52 comprises the receiver 30, a signal-processing unit 55, an amplifier 56 connected downstream of the signal-processing unit 55, an energy supply 57, and an in-ear loudspeaker 58 connected downstream of the amplifier 56. The signal-processing unit 55 demodulates the received signals and passes the demodulated signals, which correspond to the music or speech signals of the MP3 module 53, on to the amplifier 56. The amplifier 56 amplifies the music or speech signals and passes the amplified signals on to the in-ear loudspeaker 58.

The energy supply 57 comprises a rectifier 59 and a charge capacitor 60. The rectifier 59 rectifies the current of the LC-circuit of the receiver 30 in a well known manner in order to charge the charge capacitor 60. The charge capacitor 60 supplies the signal-processing unit 55 and the amplifier 56 with electrical energy.

Finally, it should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The word "comprising" and "comprises", and the like, does not exclude the presence of elements or steps other than those listed in any claim or the specification as a whole. The singular reference of an element does not exclude the plural reference of such elements and vice-versa. In a device claim enumerating several means, several of these means may be embodied by one and the same item of hardware. The mere fact that certain measures are recited in mutually different dependent claims does not indicate that a combination of these measures cannot be used to advantage.

The invention claimed is:

1. A receiver with an antenna circuit, configured to capture a near field signal with a wavelength transmitted by a transmitter wherein the near field signal includes a reactive magnetic field and a reactive electric field said antenna circuit comprising:

a coil that captures said reactive magnetic field and generates therefrom a current having a frequency corresponding to said wavelength, wherein the largest dimension of said coil is less than 5% of said wavelength and said coil being dimensioned such that said current is distributed uniformly across said coil at each point in time; and either a monopole antenna or a dipole antenna connected to said coil and that captures said reactive electric field, wherein the length of either said monopole or a leg of said dipole, as applicable, corresponds to less than 5% of said wavelength;

wherein the receiver is configured to receive a frequency of up to 30 MHz.

2. A near field transmitter with an antenna circuit, configured to transmit a near field signal with a wavelength transmitted by the transmitter wherein the near field signal includes a reactive magnetic field and a reactive electric field said antenna circuit comprising:

a coil that transmits said reactive magnetic field wherein the coil is dimensioned such that a current flowing through said coil generates therefrom a current having a frequency corresponding to said wavelength, wherein the largest dimension of said coil is less than 5% of said wavelength and related to said transmitted reactive magnetic field is distributed uniformly across said coil at each point in time; and either a monopole antenna or a dipole antenna connected to said coil and that transmits said transmitted reactive electric field, wherein the length of either said monopole or a leg of said dipole, as applicable, corresponds to less than 5% of said wavelength;

wherein the transmitter is configured to transmit a frequency of up to 30 MHz.

3. The receiver of claim 1, wherein the receiver is a component of a RFID tag.

4. The receiver of claim 1, wherein the receiver is a component of a smart card.

5. The receiver of claim 1, wherein the receiver is a component of a mobile device.

6. A hearing aid system, comprising:

a first module with a sender configured to send a near field signal having a wavelength wherein the near field signal includes a reactive magnetic field and a reactive electric field; and a second module with a loudspeaker, a receiver configured to receive said near field signal, and a signal-processing device configured to process said received near field signal and to control said loudspeaker, wherein the receiver includes a coil that captures said reactive magnetic field and generates therefrom a current having a frequency corresponding to said wavelength, wherein the largest dimension of said coil is less than 5% of said wavelength and said coil being dimensioned such that said current is distributed uniformly across said coil at each point in time; and either a monopole antenna or a dipole antenna connected to said coil and that captures said reactive electric field, wherein the length of either said monopole or a leg of said dipole, as applicable, corresponds to less than 5% of said wavelength;

wherein the receiver is configured to receive a frequency of up to 30 MHz.

7. The transmitter of claim 2, wherein the transmitter is a component of a RFID tag.

8. The transmitter of claim 2, wherein the transmitter is a component of a smart card.

9. The transmitter of claim 2, wherein the transmitter is a component of a mobile device.

10. The receiver of claim 1, comprising a capacitor coupled to the coil, wherein the capacitance of the capacitor is selected to tune the antenna circuit to the wavelength.

11. The receiver of claim 2, comprising a capacitor coupled to the coil, wherein the capacitance of the capacitor is selected to tune the antenna circuit to the wavelength.

* * * * *